US012178345B2

(12) United States Patent
Chiang

(10) Patent No.: US 12,178,345 B2
(45) Date of Patent: Dec. 31, 2024

(54) DECORATED TREE BRACKET BASE

(71) Applicant: Ming-Yao Chiang, Kaohsiung (TW)

(72) Inventor: Ming-Yao Chiang, Kaohsiung (TW)

( * ) Notice: Subject to any disclaimer, the term of this patent is extended or adjusted under 35 U.S.C. 154(b) by 0 days.

(21) Appl. No.: 18/358,097

(22) Filed: Jul. 25, 2023

(65) Prior Publication Data

US 2024/0016327 A1 Jan. 18, 2024

(30) Foreign Application Priority Data

Jun. 20, 2023 (CN) ..... 202310732170.8

(51) Int. Cl.
*A47G 33/12* (2006.01)

(52) U.S. Cl.
CPC ..... *A47G 33/12* (2013.01)

(58) Field of Classification Search
CPC ..... A47G 33/12; A41G 1/007; F16M 11/00; F16M 11/04
See application file for complete search history.

(56) References Cited

U.S. PATENT DOCUMENTS 5,236,167 A * 8/1993 Tai ..... F16M 11/20 248/188.7
5,290,004 A * 3/1994 Frost ..... A47G 33/12 248/188.7
5,938,168 A * 8/1999 Adams ..... A47G 33/12 248/524
6,293,512 B1 * 9/2001 Ho ..... F16M 11/22 248/407
6,572,069 B1 * 6/2003 Kotthaus ..... A47G 33/12 248/521
6,739,566 B1 * 5/2004 Kao ..... A47G 33/126 248/522
9,254,055 B2 * 2/2016 Wong ..... A47G 33/12
11,478,100 B2 * 10/2022 Fiveash ..... A47G 33/12
2012/0299258 A1 11/2012 Gallagher et al.
2014/0042291 A1 2/2014 Colarusso
2014/0353456 A1 * 12/2014 Wong ..... E04H 12/22 248/523
2015/0152999 A1 6/2015 Colarusso
2016/0192798 A1 * 7/2016 Leung ..... A47G 33/12 248/528
2021/0038009 A1 * 2/2021 Beckers ..... A47G 33/12

* cited by examiner

*Primary Examiner* — Monica E Millner
(74) *Attorney, Agent, or Firm* — Hemisphere Law, PLLC; Zhigang Ma

(57) ABSTRACT

The present invention discloses a decorated tree bracket base. A locking seat is installed on an upper sleeve, the locking seat has a sleeve structure, and an inserting through hole which is the same as a center hole of the supporting tube shaft is formed in the locking seat; a plurality of elastic clamping strips are formed on the lower hole edge of the inserting through hole, and the upper end of each elastic clamping strip is connected with the lower hole edge of the inserting through hole by a single point. An elastic clamping structure can not only realize the effect of fixing the trunk of the decorated tree, but also provide a simpler and more efficient installation method and a low installation difficulty, which is more in line with the current market demand.

8 Claims, 5 Drawing Sheets

DECORATED TREE BRACKET BASE

TECHNICAL FIELD

The present invention belongs to the technical field of decoration bases, and relates to a decorated tree bracket base.

BACKGROUND

In order to improve the indoor environmental atmosphere, artificial decorated trees and other artificial crafts are often used for decoration indoors and outdoors. Among which, the most typical decorated trees are various Christmas trees used for Christmas. Traditional decorated tree structures are mostly supported by basin bases, although a basin base has the function of supporting a Christmas tree, but the volume of the basin base is usually too large, which is not easy to package and transport. In order to solve this technical problem, a frame structure which can realize folding storage is mainly used as a decorated tree supporting structure in the industry at present, for example, a Chinese invention US201821762813.4 "Christmas tree bracket with decorated structure". A base structure in this application can solve the problem of packaging and transportation in the way of storage, but also has certain drawbacks. In this application, the way for fixing a decorated tree is that a through hole is formed in a center tube, an upper tube has a screw hole corresponding to the through hole, the positions of the upper tube and the center tube are fixed by installing a finger screw, and at the same time, the trunk of the decorated tree (i.e., a decorated tree supporting rod) is extruded by a finger bolt and fixed on the base. Such a way for fixing requires hole making in the side surfaces of both the upper tube and the center tube. Therefore, the requirement for processing accuracy is high, the assembly is more difficult, and it is easy to have the condition that the size and position of the hole in the upper pipe are not corresponding to that in the center pipe, which results in that the screw cannot penetrate or is difficult to be screwed in, and thus results in the failure of installation. In addition, in the way of fixing the trunk by the screw, the screw may be stripped (i.e., the screw is turned reversely by an external force and stripped), cannot be well tightened, or become loose after tightening.

Similarly, two main component structures of the base bracket in the industry are also fixed by screws. In use, if the screws are not fixed in place, when the base is collided or impacted, the supporting legs of the base will be moved, resulting in the angle between the supporting legs becoming smaller, the supporting legs being unable to provide a sufficient supporting strength, and the tipping of the product.

SUMMARY

To solve the above technical problem, the present invention adopts the following technical solutions:

A decorated tree bracket base, comprising a main bracket and an auxiliary bracket, wherein the main bracket comprises an upper sleeve, a lower sleeve, main supporting legs connected with the upper sleeve and main struts connected between the main supporting legs and the lower sleeve; the auxiliary bracket comprises a supporting tube shaft for insertion of a decorated tree supporting rod, auxiliary supporting legs connected with the supporting tube shaft and auxiliary struts connected between the supporting tube shaft and the auxiliary supporting legs;

The upper sleeve and the lower sleeve are respectively sheathed on and rotationally mated with the upper and lower ends of the supporting tube shaft, so as to realize the rotation and closing effect of the main supporting legs and the auxiliary supporting legs; a locking seat is installed on an upper sleeve, through the locking seat, the angle between the upper sleeve or a lower sleeve and a supporting tube shaft can be locked, and a decorated tree supporting rod can be locked and fixed in the supporting tube shaft;

The locking seat has a sleeve structure, and an inserting through hole which is the same as a center hole of the supporting tube shaft is formed in the locking seat; a plurality of elastic clamping strips are formed on the lower hole edge of the inserting through hole, and the upper end of each elastic clamping strip is connected with the lower hole edge of the inserting through hole by a single point, so as to make the elastic clamping strips have a certain deformation property; the elastic clamping strips are mated with each other to form a connecting ferrule with a cylindrical structure, and the connecting ferrule has an inverted conical structure with a wide upper end and a narrow lower end;

A locking assembly used for locking the upper sleeve and the supporting tube shaft is arranged on the locking seat; an inner cavity used for accommodating the locking assembly is formed in the inner cylinder wall of the locking seat, and an avoidance opening used for avoiding the inner cavity is formed in the upper sleeve;

The locking assembly comprises a locking pin, a pressing spring and a locking key; the locking pin and the pressing spring are arranged in the inner cavity, the pressing spring is arranged on the upper end of the locking pin, and a downward pressure is provided by the pressing spring to the locking pin; the locking key is arranged outside the locking seat, the locking key is connected and mated with the locking pin, and the locking key is provided to realize the manual lifting of the locking pin;

A locking groove is formed in the upper edge of the supporting tube shaft; when the locking groove is aligned with the avoidance opening, the lower end of the locking pin is pushed into the locking groove by the pressing spring, and the supporting tube shaft is locked and fixed with the upper sleeve.

As a further solution of the present invention, a clamping gap is formed between the cylinder wall of the locking seat and the connecting ferrule, the upper end of the upper sleeve is inserted into the clamping gap, and two symmetrically arranged clamping blocks are arranged in the clamping gap; clamping notches are formed in the upper sleeve corresponding to the clamping blocks; when the locking seat is installed on the upper sleeve, the clamping blocks are stuck into the clamping notches to realize installation.

As a further solution of the present invention, the clamping blocks are formed at the rear ends of the elastic clamping strips, and each clamping block is composed of a contact surface which is abutted against the clamping notch and an inclined surface which is inclined inwards from top to bottom to the side of the elastic clamping strip.

As a further solution of the present invention, reinforcing ribs used for improving connection strength are formed at the junction between the elastic clamping strips and the locking seat.

As a further solution of the present invention, pressing ridges are formed on the inner end surface of each elastic clamping strip along the length direction thereof.

As a further solution of the present invention, a rotation guide slot is formed in the supporting tube shaft along the perimeter direction thereof;

A pin hole corresponding to the rotation guide slot is formed in the lower sleeve and a limiting pin is installed in the pin hole; when the lower sleeve and the supporting tube shaft are installed and mated, the limiting pin is inserted into the rotation guide slot to limit the movement stroke for the rotational mating between the lower sleeve and the supporting tube shaft.

As a further solution of the present invention, the overall length of the rotation guide slot is one fourth of the circumference of the supporting tube shaft, so as to make the movement stroke for the rotational mating between the lower sleeve and the supporting tube shaft be limited to 90° rotation.

As a further solution of the present invention, a lower hole of the lower sleeve is a bottom positioning hole; the bottom positioning hole adopts one of the structures including but not limited to rectangular, triangular, polygonal and plum-blossom-shaped positioning holes.

The present invention has the following beneficial effects: a locking seat structure is added to replace a traditional screw limit structure, and the effect of clamping installation of a decorated tree is realized by the connecting ferrule composed of the elastic clamping strips. Compared with a traditional screw extrusion structure, this type of elastic clamping structure can not only realize the effect of fixing the trunk of the decorated tree, but also provide a simple and more efficient installation method and a low installation difficulty, which is more in line with the current market demand;

At the same time, the locking assembly in the locking seat can realize the fixing and limitation of the main bracket and the auxiliary bracket, so that the folding storage and expansion of the main bracket and the auxiliary bracket are more convenient. Compared with a traditional screw fastening structure, the present invention is more convenient to use, and the processing tolerance is higher, which can effectively reduce the processing cost. In addition, the locking seat and the base adopt a fixed mating structure, which can better realize transportation, and avoid the condition that the base cannot be used normally due to the losing of a small screw part in the traditional screw base structure during transportation.

DETAILED DESCRIPTION

The technical solution in the embodiments of the present application will be clearly and fully described below in combination with the drawings in the embodiments of the present application. Apparently, the described embodiments are merely part of the embodiments of the present application, not all of the embodiments. It should be understood that the present application is not limited by the example embodiments disclosed and described here. Based on the embodiments in the present application, all other embodiments obtained by those ordinary skilled in the art without contributing creative labor will belong to the protection scope of the present application.

It should be understood in the description of the present invention that terms such as "length", "width", "upper", "lower", "front", "rear", "left", "right", "vertical", "horizontal", "top", "bottom", "inner", "outer", etc. indicate direction or position relationships shown based on the drawings, and are only intended to facilitate the description of the present invention and the simplification of the description rather than to indicate or imply that the indicated device or element must have a specific direction or constructed and operated in a specific direction, and therefore, shall not be understood as a limitation to the present invention.

In addition, the terms such as "first" and "second" are only used for the purpose of description, rather than being understood to indicate or imply relative importance or hint the number of indicated technical features. Thus, the features limited by "first" and "second" can explicitly or impliedly comprise one or more features. In the description of the present invention, the meaning of "a plurality of" is two or more unless otherwise clearly specified.

In the embodiments of the present invention, unless otherwise specifically regulated and defined, terms such as "installation", "connected", "connecting", "fixed" and the like shall be understood in broad sense, and for example, may refer to fixed connection or detachable connection or integral connection, may refer to mechanical connection or electrical connection, and may refer to direct connection or indirect connection through an intermediate medium or inner communication of two elements or interaction relationship of two elements. For those ordinary skilled in the art, the specific meanings of the above terms in the present invention may be understood according to concrete conditions.

Figure 1:
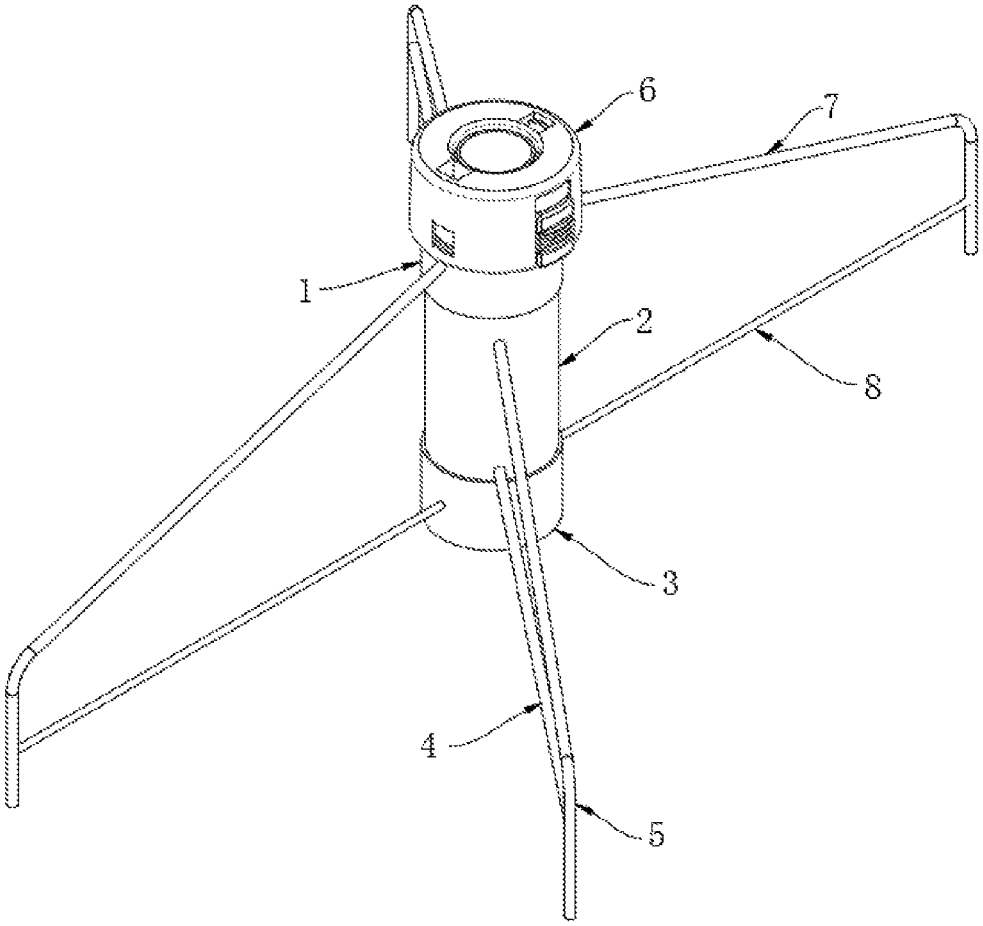
FIG. 1 is a structural schematic diagram of the present invention.
Figure 2:
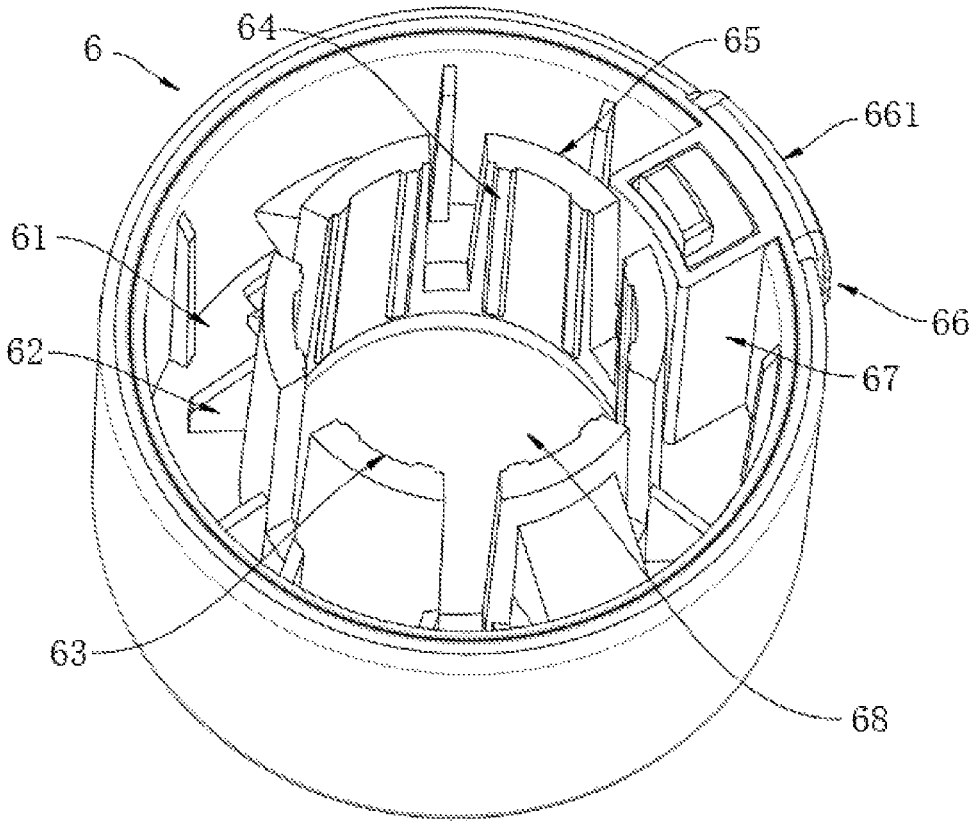
FIG. 2 is a structural schematic diagram of a locking seat of the present invention.
Figure 3:
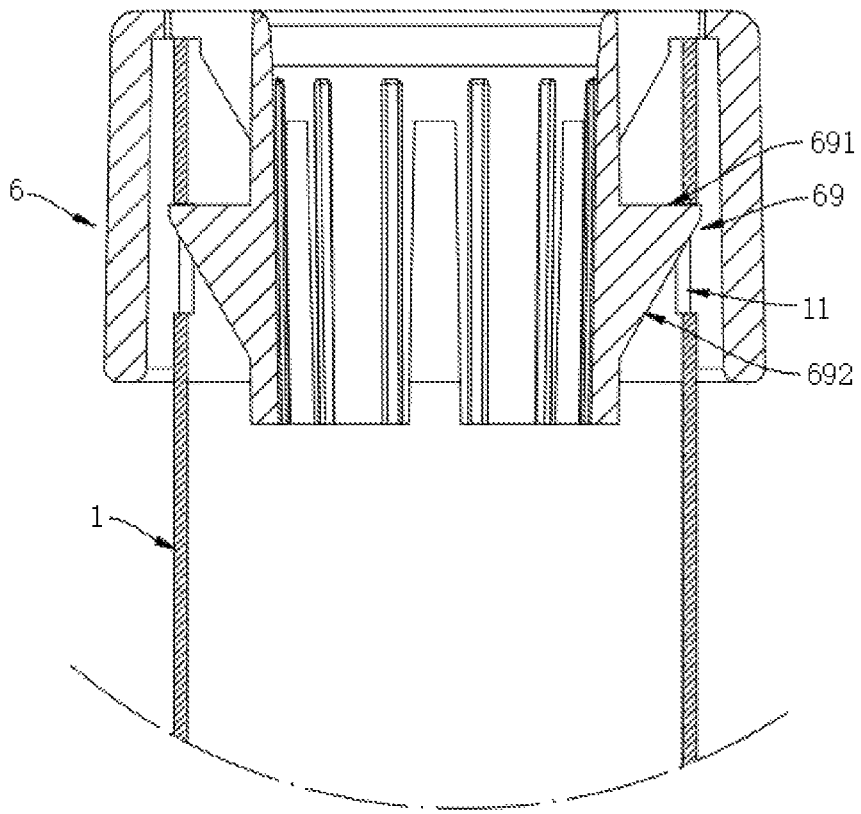
FIG. 3 is a structural schematic diagram of connection of a locking seat and an upper sleeve of the present invention.
Figure 4:
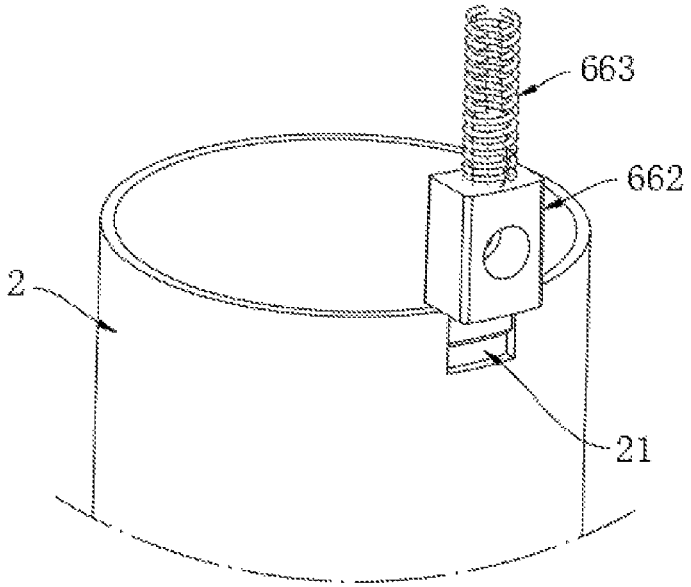
FIG. 4 is a structural schematic diagram of mating of a locking assembly and a supporting tube shaft of the present invention.
Figure 5:
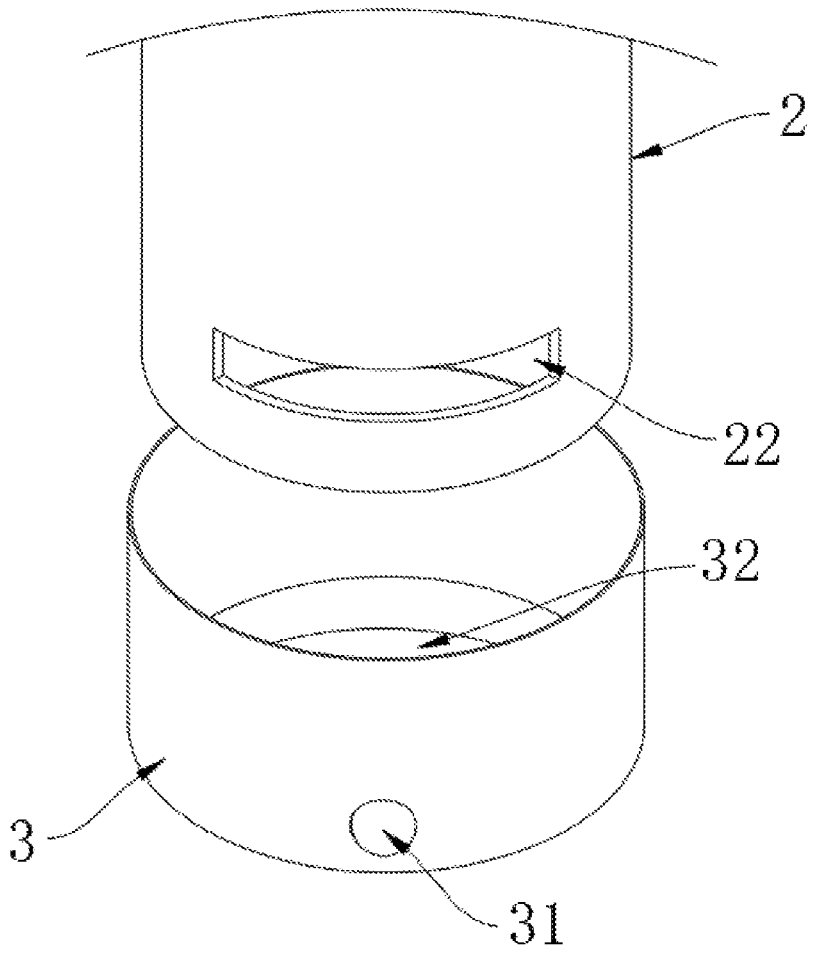
FIG. 5 is a structural schematic diagram of a rotation guide slot of the present invention.

Referring to FIGS. 1-5, the present invention provides, in an embodiment, a decorated tree bracket base used for supporting a decorated tree, comprising a main bracket and an auxiliary bracket, wherein the main bracket comprises an upper sleeve 1, a lower sleeve 3, main supporting legs 7 connected with the upper sleeve 1 and main struts 8 connected between the main supporting legs 7 and the lower sleeve 3; the auxiliary bracket comprises a supporting tube shaft 2 for insertion of a decorated tree supporting rod, auxiliary supporting legs 5 connected with the supporting tube shaft 2 and auxiliary struts 4 connected between the supporting tube shaft 2 and the auxiliary supporting legs 5;

The upper sleeve 1 and the lower sleeve 3 are respectively sheathed on and rotationally mated with the upper and lower ends of the supporting tube shaft 2, so as to realize the rotation and closing effect of the main supporting legs 7 and the auxiliary supporting legs 5;

A locking seat 6 is arranged on the upper sleeve 1, through the locking seat 6, the angle between the upper sleeve 1 or the lower sleeve 3 and the supporting tube shaft 2 can be locked, and the decorated tree supporting rod can be locked and fixed in the supporting tube shaft 2;

The locking seat 6 has a sleeve structure, and an inserting through hole 68 which is the same as a center hole of the supporting tube shaft 2 is formed in the locking seat 6; a plurality of elastic clamping strips 65 are formed on the lower hole edge of the inserting through hole 68, and the upper end of each elastic clamping strip 65 is connected with the lower hole edge of the inserting through hole 68 by a single point, so as to make the elastic clamping strips 65 have a certain deformation property; the elastic clamping strips 65 are mated with each other to form a connecting ferrule 63 with a cylindrical structure, and the connecting ferrule 63 has an inverted conical structure with a wide upper end and a narrow lower end; during the installation of a decorated tree, as the decorated tree supporting rod is inserted into the connecting ferrule 63 from top to bottom, and the overall diameter of the decorated tree supporting rod is greater than the inner diameter of the connecting ferrule 63, the elastic clamping strips 65 are deformed when the decorated tree supporting rod is inserted, and the decorated tree supporting rod is clamped by the resilience of the elastic clamping strips 65 to achieve the installation effect;

A locking assembly 66 used for locking the upper sleeve 1 and the supporting tube shaft 2 is arranged on the locking seat 6; an inner cavity 67 used for accommodating the locking assembly 66 is formed in the inner cylinder wall of the locking seat 6, and an avoidance opening used for avoiding the inner cavity 67 is formed in the upper sleeve 1;

The locking assembly 66 comprises a locking pin 662, a pressing spring 663 and a locking key 661; the locking pin 662 and the pressing spring 663 are arranged in the inner cavity 67, the pressing spring 663 is arranged on the upper end of the locking pin 662, and a downward pressure is provided by the pressing spring 663 to the locking pin 662; the locking key 661 is arranged outside the locking seat 6, the locking key 661 is connected and mated with the locking pin 662, and the locking key 661 is provided to realize the manual lifting of the locking pin 662;

A locking groove 21 is formed in the upper edge of the supporting tube shaft 2; when the main supporting legs 7 and the auxiliary supporting legs 5 are opened to the most reasonable supporting angle (at present, four supporting legs, i.e., two main supporting legs 7 and two auxiliary supporting legs 5, are commonly used, so the best supporting angle is that the four supporting legs form a cross structure), the locking groove 21 is aligned with the avoidance opening, the lower end of the locking pin 662 is pushed into the locking groove 21 by the pressing spring 663, and the supporting tube shaft 2 is locked and fixed with the upper sleeve 1, thus to fix the angle between the main supporting legs 7 and the auxiliary supporting legs 5; when the supporting legs needs to be stored, the locking pin 662 can be driven by the locking key 661 to be lifted and released from limitation.

Further, a clamping gap 61 is formed between the cylinder wall of the locking seat 6 and the connecting ferrule 63, the upper end of the upper sleeve 1 is inserted into the clamping gap 61, and two symmetrically arranged clamping blocks 69 are arranged in the clamping gap 61; clamping notches 11 are formed in the upper sleeve 1 corresponding to the clamping blocks 69; when the locking seat 6 is installed on the upper sleeve 1, the clamping blocks 69 are stuck into the clamping notches 11 to realize installation.

Further, the clamping blocks 69 are formed at the rear ends of the elastic clamping strips 65, and each clamping block is composed of a contact surface 691 which is abutted against the clamping notch 11 and an inclined surface 692 which is inclined inwards from top to bottom to the side of the elastic clamping strip 65; during the installation of the locking seat 6, the locking seat 6 is installed on the upper sleeve 1 from top to bottom, the inclined surface 692 of each clamping block 69 will first come into contact with the inner wall of the upper sleeve 1; due to the structural design of the inclined surfaces 692, the clamping blocks 69 will not be limited in the process of moving downwards, but the elastic clamping strips 65 with the clamping blocks 69 will be squeezed backwards to be deformed; when the clamping blocks 69 are aligned with the clamping notches 11, the extrusion pressure on the elastic clamping strips 65 disappear, the elastic clamping strips 65 rebound to make the clamping blocks 69 stuck into the clamping notches 11 to realize the installation of locking seat 6 on the upper sleeve 1, and the contact surfaces 691 will be abutted against the upper edge of the clamping notches 11 to make the locking seat 6 unable to escape from the upper sleeve 1.

Further, reinforcing ribs 62 used for improving connection strength are formed at the junction between the elastic clamping strips 65 and the locking seat 6 to avoid fracture when the elastic clamping strips 65 are deformed and improve the service life of the overall base structure.

Further, pressing ridges 64 are formed on the inner end surface of each elastic clamping strip 65 along the length direction thereof, and the clamping force of the clamping strips 65 on the decorated tree supporting rod is increased by the pressing ridges 64, so as to better realize the supporting and installation of the decorated tree.

Further, a rotation guide slot 22 is formed in the supporting tube shaft 2 along the perimeter direction thereof;

A pin hole corresponding to the rotation guide slot 22 is formed in the lower sleeve 3 and a limiting pin 31 is installed in the pin hole; when the lower sleeve 3 and the supporting tube shaft 2 are installed and mated, the limiting pin 31 is inserted into the rotation guide slot 22 to limit the movement stroke for the rotational mating between the lower sleeve 3 and the supporting tube shaft 2.

In actual implementation, the overall length of the rotation guide slot 22 will be determined according to the number of supporting legs for different numbers of supporting legs, for example, in a base structure with four supporting legs (i.e., two main supporting legs 7 and two auxiliary supporting legs 5), the best supporting angle is that the four supporting legs form a cross structure. Therefore, the overall length of the rotation guide slot 22 is designed to be one fourth of the circumference of the supporting tube shaft 2, so as to make the movement stroke for the rotational mating between the lower sleeve 3 and the supporting tube shaft 2 be limited to 90° rotation. Similarly, in a base structure with a different number of supporting legs, the overall length of the rotation guide slot 22 can be adjusted accordingly, so as to make the movement stroke for the rotational mating between the lower sleeve 3 and the supporting tube shaft 2 be limited to a reasonable angle, ensure that the open supporting legs are the most reasonable supporting positions, and improve the stability of the base structure.

Further, a lower hole of the lower sleeve 3 is a bottom positioning hole 32; the bottom positioning hole 32 adopts one of the structures including but not limited to rectangular, triangular, polygonal and plum-blossom-shaped positioning holes; accordingly, the lower end of the decorated tree supporting rod will adopt a structure with a corresponding shape; when the decorated tree supporting rod is installed into the supporting tube shaft 2, the lower end of the decorated tree supporting rod is inserted into the bottom positioning hole 32 and limited by a corresponding positioning structure to avoid unnecessary rotation of the decorated tree and avoid shaking of the decorated tree.

It should also be noted that herein, relationship terms of first, second and the like herein are just used for differentiating one entity or operation from the other entity or operation, and do not necessarily require or imply any practical relationship or sequence between the entities or operations. Moreover, terms of "comprise", "include" or any other variant are intended to cover non-exclusive inclusion, so that a process, a method, an article or a device which includes a series of elements not only includes such elements, but also includes other elements not listed clearly or also includes inherent elements in the process, the method, the article or the device. Under the condition of no more limitation, the elements defined by a sentence "include one . . . " do not exclude additional identical elements in the process, the method, the article or the terminal device which includes the elements.

The above description of the disclosed embodiments enables those skilled in the art to realize or use the present application. Many modifications to these embodiments will be apparent to those skilled in the art. The general principle defined herein can be realized in other embodiments without departing from the spirit or scope of the present application. Therefore, the present application will not be limited to these embodiments shown herein, but will conform to the widest scope consistent with the principle and novel features disclosed herein.

The invention claimed is:

1. A decorated tree bracket base, comprising a main bracket and an auxiliary bracket, wherein the main bracket comprises an upper sleeve, a lower sleeve, main supporting legs connected with the upper sleeve and main struts connected between the main supporting legs and the lower sleeve; the auxiliary bracket comprises a supporting tube shaft, auxiliary supporting legs connected with the supporting tube shaft and auxiliary struts connected between the supporting tube shaft and the auxiliary supporting legs;

the upper sleeve and the lower sleeve are respectively sheathed on and rotationally mated with the upper and lower ends of the supporting tube shaft, so as to realize the rotation and closing effect of the main supporting legs and the auxiliary supporting legs; a locking seat is installed on the upper sleeve, through the locking seat, the angle between the upper sleeve or the lower sleeve and the supporting tube shaft can be locked;

the locking seat has a sleeve structure, and an inserting through hole which is the same as a center hole of the supporting tube shaft is formed in the locking seat; a plurality of elastic clamping strips are formed on the lower hole edge of the inserting through hole, and the upper end of each elastic clamping strip is connected with the lower hole edge of the inserting through hole by a single point, so as to make the elastic clamping strips have a certain deformation property; the elastic clamping strips are mated with each other to form a connecting ferrule with a cylindrical structure, and the connecting ferrule has an inverted conical structure with a wide upper end and a narrow lower end;

a locking assembly used for locking the upper sleeve and the supporting tube shaft is arranged on the locking seat; an inner cavity used for accommodating the locking assembly is formed in the inner cylinder wall of the locking seat, and an avoidance opening used for avoiding the inner cavity is formed in the upper sleeve;

the locking assembly comprises a locking pin, a pressing spring and a locking key; the locking pin and the pressing spring are arranged in the inner cavity, the pressing spring is arranged on the upper end of the locking pin, and a downward pressure is provided by the pressing spring to the locking pin; the locking key is arranged outside the locking seat, the locking key is connected and mated with the locking pin, and the locking key is provided to realize the manual lifting of the locking pin;

a locking groove is formed in the upper edge of the supporting tube shaft; when the locking groove is aligned with the avoidance opening, the lower end of the locking pin is pushed into the locking groove by the pressing spring, and the supporting tube shaft is locked and fixed with the upper sleeve.

2. The decorated tree bracket base according to claim 1, wherein a clamping gap is formed between the cylinder wall of the locking seat and the connecting ferrule, the upper end of the upper sleeve is inserted into the clamping gap, and two symmetrically arranged clamping blocks are arranged in the clamping gap; clamping notches are formed in the upper sleeve corresponding to the clamping blocks; when the locking seat is installed on the upper sleeve, the clamping blocks are stuck into the clamping notches to realize installation.

3. The decorated tree bracket base according to claim 2, wherein the clamping blocks are formed at the rear ends of the elastic clamping strips, and each clamping block is composed of a contact surface which is abutted against the clamping notch and an inclined surface which is inclined inwards from top to bottom to the side of the elastic clamping strip.

4. The decorated tree bracket base according to claim 1, wherein reinforcing ribs used for improving connection strength are formed at the junction between the elastic clamping strips and the locking seat.

5. The decorated tree bracket base according to claim 1, wherein pressing ridges are formed on the inner end surface of each elastic clamping strip along the length direction thereof.

6. The decorated tree bracket base according to claim 1, wherein a rotation guide slot is formed in the supporting tube shaft along the perimeter direction thereof;

a pin hole corresponding to the rotation guide slot is formed in the lower sleeve and a limiting pin is installed in the pin hole; when the lower sleeve and the supporting tube shaft are installed and mated, the limiting pin is inserted into the rotation guide slot to limit the movement stroke for the rotational mating between the lower sleeve and the supporting tube shaft.

7. The decorated tree bracket base according to claim 6, wherein the overall length of the rotation guide slot is one fourth of the circumference of the supporting tube shaft, so as to make the movement stroke for the rotational mating between the lower sleeve and the supporting tube shaft be limited to 90° rotation.

8. The decorated tree bracket base according to claim 1, wherein a lower hole of the lower sleeve is a bottom positioning hole; the bottom positioning hole adopts one of the structures including but not limited to rectangular, triangular, polygonal and plum-blossom-shaped positioning holes.

* * * * *